United States Patent [19]

Olayan et al.

[11] Patent Number: 4,946,158

[45] Date of Patent: Aug. 7, 1990

[54] BABY WALKER

[76] Inventors: Hamad Olayan, P.O. Box 15391, Riyadh, 11444, Saudi Arabia; George Spector, 233 Broadway Rm 3815, New York, N.Y. 10007

[21] Appl. No.: 311,055

[22] Filed: Feb. 16, 1989

[51] Int. Cl.[5] ..... A63B 1/00; A61H 3/00

[52] U.S. Cl. ..... 272/70.3; 280/87.051; 280/755

[58] Field of Search ..... 272/70.3; 280/62, 47.2, 280/47.21, 47.22, 87.01, 47.16, 87.051, 755, 304, 293, 62

[56] References Cited

U.S. PATENT DOCUMENTS

| | | | |
|---|---|---|---|
| 202,724 | 4/1878 | Headler | 272/70 |
| 1,492,202 | 4/1924 | Carroll | 280/87.051 |
| 2,402,322 | 6/1946 | Flynn | 280/755 |
| 2,973,209 | 2/1961 | Shaw | 280/755 |

*Primary Examiner*—Stephen R. Crow

[57] ABSTRACT

An infant walker is provided and consists of a handle elevated and supported over a three wheeled T-shaped base member so that the infant can stand up and push the infant walker when learning how to walk. In a modification a stablilizer is provided on the base member to prevent the infant walker from tipping over when the infant pushes it. The stabilizer includes a slidable shaft having wheels on the distal ends, and tensioning structure for adjusting the lateral sliding of the shaft relative to the base member.

2 Claims, 1 Drawing Sheet

BABY WALKER

BACKGROUND OF THE INVENTION

The instant invention relates generally to supportive devices and more specifically it relates to an infant walker.

Numerous supportive devices have been provided in prior art that are adapted to include frames in which infants sit within to learn how to walk. While these units may be suitable for the particular purpose to which they address, they would not be as suitable for the purposes of the present invention as heretofore described.

SUMMARY OF THE INVENTION

A primary object of the present invention is to provide an infant walker that will overcome the shortcomings of the prior art devices.

Another object is to provide an infant walker in which the infant can grip an elevated handle supported over three wheels so that the infant can push the infant walker when learning how to walk.

An additional object is to provide an infant walker that includes a slideable stabilizer with wheels thereon to prevent the infant walker from tipping over when the infant pushes the infant walker.

A further object is to provide an infant walker that is simple and easy to use.

A still further object is to provide an infant walker that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
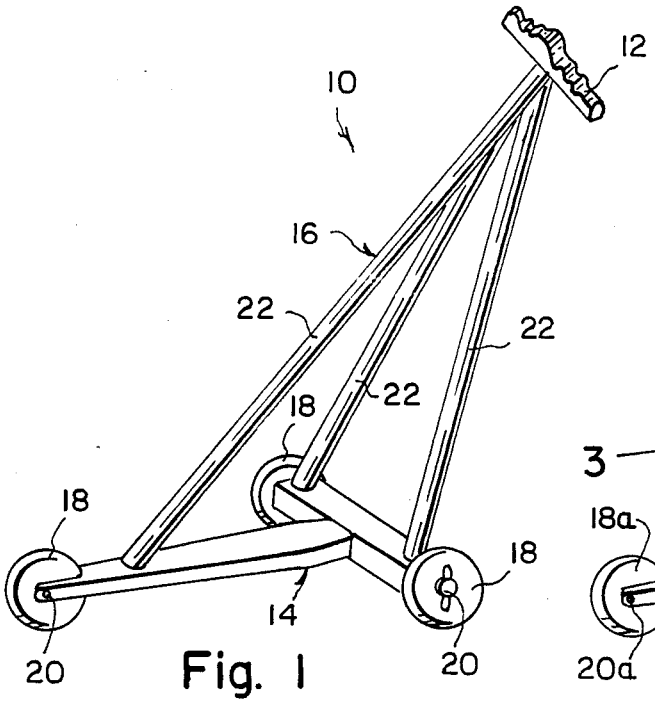
FIG. 1 is a perspective view of the invention.

Turning now descriptively to the drawings, in which similar reference characters denote similar elements throughout the several views, FIG. 1 illustrates an infant walker 10 consisting of a handle 12 to be gripped by two hands of an infant (not shown) and a T-shaped base member 14. A structure 16 is provided for elevating the handle over the T-shaped base member 14 so that the infant can stand up with respect to the infant walker 10. A wheel 18 is rotatably connected at 20 to each distal end of the T-shaped base member 14 making the infant walker 10 portable so that the infant can push the infant walker when learning how to walk. As shown the structure 16 is angled back to better position the handle 12 for the infant and includes three support legs 22. Each of the legs 22 extends upwardly from one distal end of the T-shaped base member 14 to converge to meet and connect to middle of the handle 12.

Figure 2:
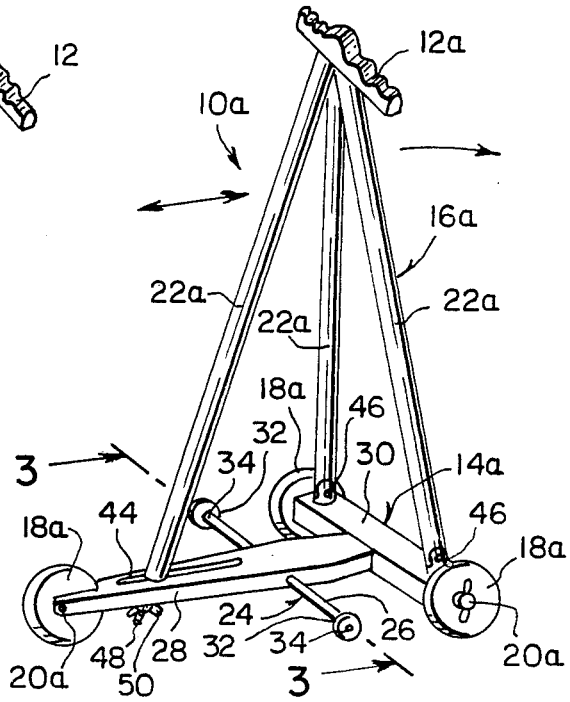
FIG. 2 is a perspective view of a modification of the infant walker with a slideable stabilizer with pair of small wheels thereon and showing adjustable legs so that the handle of the infant walker can be placed at an angle with respect to the rest of the infant walker making it easier for the infant to push it.

A modified infant walker **10*a* is shown in FIG. 2 containing a structure 24 for preventing the infant walker from tipping over when the infant pushes against the handle 12*a*. The structure 24 includes a stabilizer shaft 26 extending transversely through long section 28 of the T-shaped base member 14*a* parallel with short section 30 of the T-shaped base member 14*a*. A small wheel 32 is rotatably connected at 34 to each distal end of the stabilizer shaft 26 so as to prevent the infant walker 10*a* from tipping over when the infant pushes against the handle 12*a***.

Figure 3:
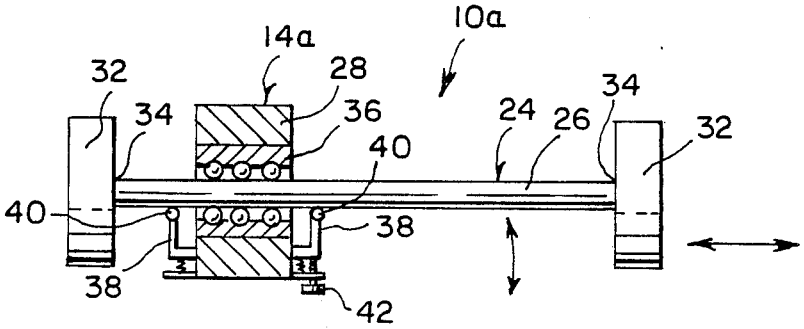
FIG. 3 is an enlarged cross sectional view taken along line 3—3 in FIG. 2 showing the internal mechanism of the slideable stabilizer.

As shown in FIG. 3, structure 24 further includes a ball bearing collar 36 within the long section 28 of the T-shaped base member **14*a* so that the stabilizer shaft can slide therethrough to be adjustable when the infant walker 10*a* tips to the right and to the left. A pair of spring biased L-shaped brackets 38 are each mounted to an opposite side of the long section 28 of the T-shaped base member 14*a* below the ball bearing collar 36. A roller 40 is disposed on a distal end of each of the brackets 38 so as to bear against the stabilizer shaft 26. A screw 42 is provided in one of the brackets 38 to adjust pressure of the roller 40 against the stabilizer shaft 26 to control movement of the stabilizer shaft when the infant tips the infant walker 10*a***.

The modified infant walker **10*a* shown in FIG. 2, further includes the T-shaped base member 14*a* having an elongated slot 44 in the long section 28. A pair of pivot segments 46 are each formed into one of two of the support legs 22*a* adjacent the distal ends of the short section 30 of the T-shaped base member 14*a*. A reduced threaded end 48 is formed on distal end of the third of the support legs 22*a*. The threaded end 48 can fit and slide within the elongated slot 44 so as to adjust the support legs 22*a* allowing the handle 12*a* of the infant walker 10*a* to be placed at an angle with respect to the T-shaped base member 14*a* making it easier for the infant to push it. A wing nut 50 is threaded onto the threaded end 48 to lock the support legs 22*a*** in different angles.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An infant walker which comprises:

(a) a handle to be gripped by two hands of an infant;

(b) a T-shaped base member;

(c) means for elevating said handle over said T-shaped base member so that the infant can stand up with respect to the infant walker; said elevating means includes three support legs, in which each of said legs extends upwardly from one distal end of said T-shaped base member to converge to meet and connect to a middle region of said handle;

(d) three wheels, in which each of said wheels is rotatably connected to one distal end of said T-shaped base member making said infant walker portable so that the infant can push said infant walker when learning how to walk;

(e) preventing means comprising:

(a) a stabilizer shaft extending transversely through the long section of said T-shaped base member parallel with the short section of said T-shaped base member; and (b) a pair of small wheels each of which is rotatably connected to one distal end of said stabilizer shaft so as to prevent said infant walker from laterally tipping over when the infant pushes against said handle.

(c) a ball bearing collar within the long section of said T-shaped base member so that said stabilizer shaft can slide therethrough to be adjustable when said infant walker tips to the right and to the left;

(d) a pair of spring biased L-shaped brackets each mounted to an opposite side of the long section of said T-shaped base member below said ball bearing collar;

(e) a pair of rollers each disposed on a distal end of each of said brackets so as to bear against said stabilizer shaft; and (f) a screw in one of said brackets to adjust the pressure of said roller against said stabilizer shaft to control movement of said stabilizer shaft when the infant tips said infant walker.

2. An infant walker as recited in claim 1, further comprising:

(a) said T-shaped base member having an elongated slot in the long section;

(b) a pair of pivot segments each formed into one of the two said support legs adjacent the distal ends of the short section of said T-shaped base member;

(c) a reduced threaded end formed on a distal end of the third said support leg whereby said threaded end can fit and slide within said elongated slot so as to adjust said support legs allowing said handle of said infant walker to be placed at an angle with respect to said T-shaped base member; and (d) a wing nut threaded onto said threaded end to lock said support legs in different angles.

* * * * *